United States Patent [19]

Bischofberger et al.

[11] 4,072,836

[45] Feb. 7, 1978

[54] ELECTRICAL SWITCH WITH MEANS FOR SWITCHING AN AUXILIARY RESISTANCE INTO THE CIRCUIT CONTROLLED THEREBY

[75] Inventors: Walter Bischofberger, Zurich; Gerhard Mauthe, Birmenstorf, both of Switzerland

[73] Assignee: BBC Brown, Boveri & Company Limited, Baden, Switzerland

[21] Appl. No.: 631,215

[22] Filed: Nov. 12, 1975

[30] Foreign Application Priority Data

Nov. 22, 1974 Switzerland ..... 15552/74

[51] Int. Cl.[2] ..... H01H 33/16

[52] U.S. Cl. ..... 200/144 AP; 200/325

[58] Field of Search ..... 200/144 AP, 48 R, 73, 200/74, 318, 323, 324, 325

[56] References Cited

U.S. PATENT DOCUMENTS

| | | | |
|---|---|---|---|
| 3,538,276 | 11/1970 | Leeds | 200/144 AP |
| 3,700,840 | 10/1972 | Wilson et al. | 200/48 R |
| 3,763,340 | 10/1973 | Noack | 200/144 AP |

*Primary Examiner*—Robert S. Macon

*Attorney, Agent, or Firm*—Pierce, Scheffler & Parker

[57] ABSTRACT

An electrical switch is provided with at least one set of stationary and movable main contacts for opening and closing the circuit controlled by it, and a set of stationary and movable auxiliary contacts for connecting a resistor in parallel with the main contacts and hence into the circuit controlled by the switch during a switching-in operation prior to engagement of the main contacts. The resistor is then disconnected either after the main contacts have engaged, or it is disconnected later during a switching-out operation prior to disengagement of the main contacts. Both operational modes are effected by means of a follower device which couples the movable auxiliary contact with the movable main contact.

3 Claims, 6 Drawing Figures

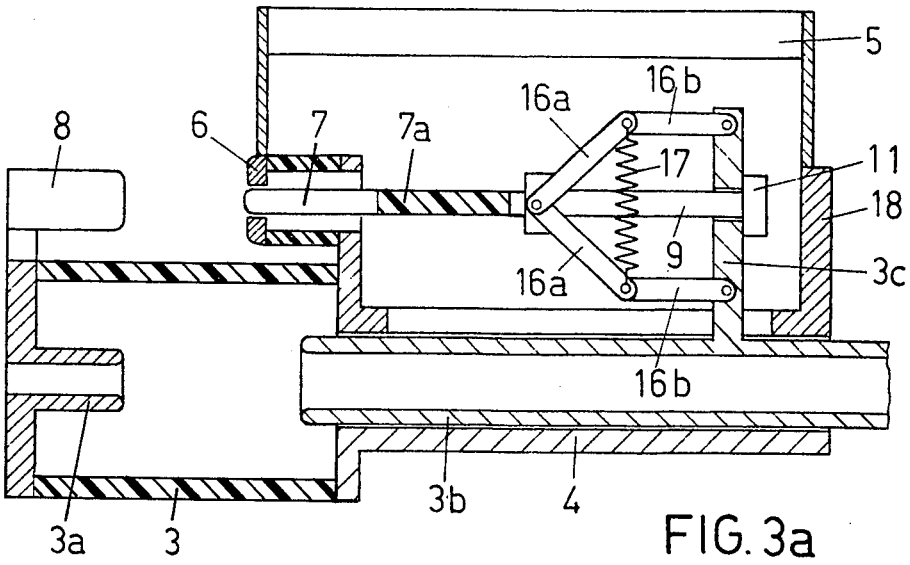
FIG. 3a
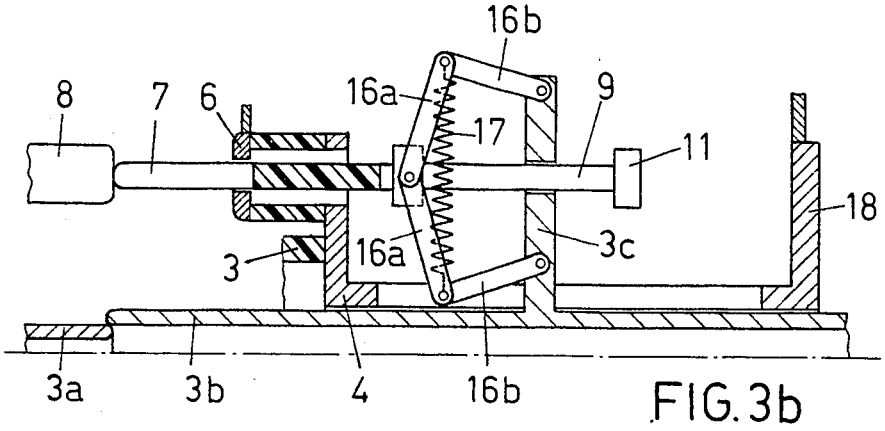
FIG. 3b
FIG. 3c
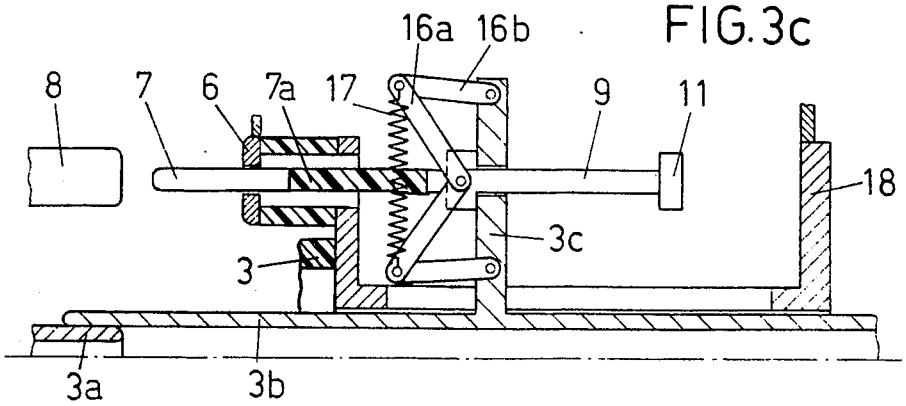

ELECTRICAL SWITCH WITH MEANS FOR SWITCHING AN AUXILIARY RESISTANCE INTO THE CIRCUIT CONTROLLED THEREBY

This invention relates to an improvement in an electrical switch provided with at least one set of main contacts for opening and closing the circuit controlled by it, and a set of auxiliary contacts for connecting a resistor in parallel with the main contacts and hence into the circuit controlled by the switch during a switching-in operation prior to engagement of the main contacts. The resistor is then disconnected either after the main contacts have engaged, or it is disconnected later during a switching-out operation prior to disengagement of the main contacts.

It is known that more or less intense voltage surges, depending on circuit conditions, can occur during the closing of the contacts of a high voltage switch. One known method of reducing the intensity of such voltage surges is by connecting a resistor or proper low value into the circuit just prior to the time of engagement between the main contacts (for example, see U.S. Pat. No. 3,291,947).

It is further known in the case of switches with multiple sets of circuit interrupting contacts to connect resistors by means of auxiliary contacts in parallel with each set of circuit interrupting contacts of the switch, and to arrange the control of such resistors in such manner that during the circuit-opening operation all resistors will become operative, while during the circuit-closing operation only some of the resistors will become effective (see German patent DT-PS 1,227,536), an arrangement which is relatively complicated, especially the control of the various switching points.

The principal object of this invention is to provide an improved arrangement for switching such a resistor in and out which is both simple and economic, in design as well as controlwise.

In accordance with the invention, the set of auxiliary contacts for controlling switching of the resistor into and out of the circuit includes a stationary auxiliary contact connected electrically with the stationary contact of the set of main contacts and a movable auxiliary contact coupled for movement with the movable main contact by means of a follower device. The resistor is electrically connected at one end to the movable main contact and its opposite end is electrically connected to the movable auxiliary contact.

This novel arrangement has the advantage that it will save space, especially in the case of switches of the enclosed type when the sets of main and auxiliary contacts are placed axially parallel side-by-side.

Figure 1:
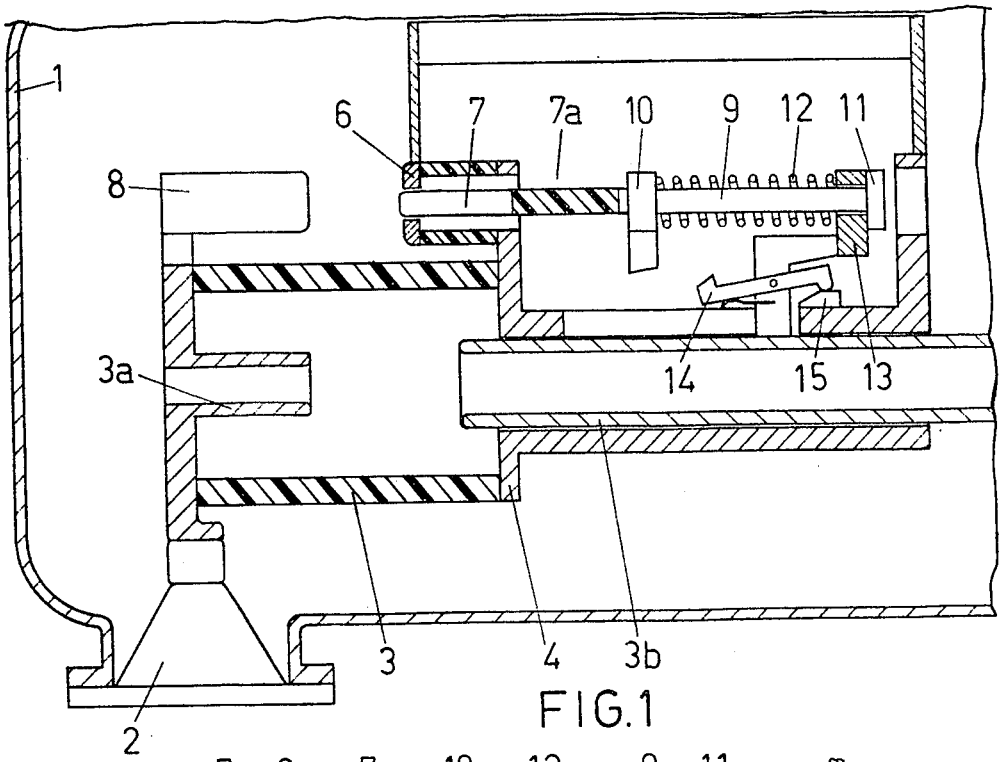
Figure 2A:
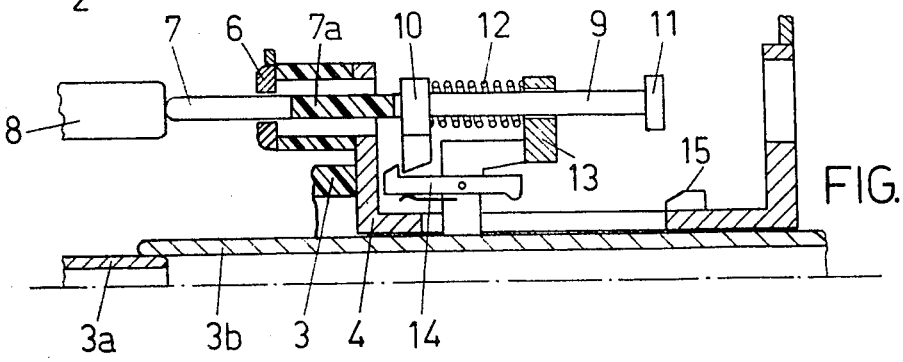
Figure 2B:
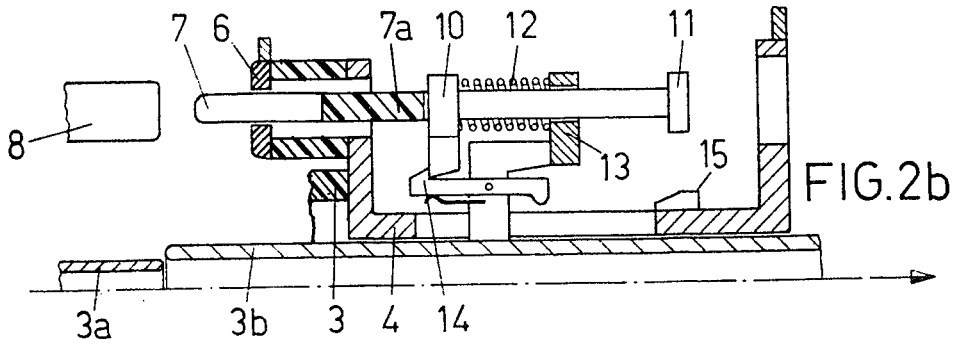

Two preferred embodiments of the invention are shown in the accompanying drawing wherein:

FIG. 1 shows a partial section of a switch of the enclosed type, with the sets of main and auxiliary contacts arranged according to the invention, FIGS. 2*a*, 2*b* depict two characteristic switch positions of the arrangement shown by FIG. 1, and FIGS. 3*a*, 3*b* and 3*c* show three characteristic switch positions for a species which differs from the one illustrated by FIG. 1.

FIG. 1 shows a switch of the enclosed type including a casing 1 which is grounded and is filled with insulating pressurized gas, for example $SF_6$. The voltage-carrying parts of the switch rest at the bushing insulator 2 which is pressure-gas-tight. A housing 3 made of insulating material inside of the casing 1 provides a switching chamber for the tubular movable main contact 3*b* and the stationary tubular main contact 3*a*. Also included is a not illustrated conventional arrangement for blasting the contacts with the pressurized gas and a drive of conventional type for the movable contact 3*b*.

An electrically conductive metallic part 4 is supported at, and closes off, one end of the housing 3. It is provided with a longitudinal bore through which the movable main tubular contact 3*b* is guided by its drive in the direction of the stationary main contact 3*a* which closes the other end of housing 3. The guide part 4 being electrically conductive and in surface engagement with the slidable tubular contact 3*b* has the same potential as that of contact 3*b*, and includes a lateral extension 4*a* at one end connected to one end of resistor 5. A lateral expansion 4*b* at the other end of the guide part 4 supports a tubular resistor 20 at one end thereof, and an annular member 6 of electrically conductive material supported at the opposite end is electrically connected to the other end of resistor 5.

The auxiliary contacts which control switching of resistor 5 into and out of the circuit consist of a stationary contact 8 which is supported by the stationary main contact 3*a* and electrically connected therewith, and a movable pin type contact 7 which slides back and forth through the central opening in the annular member 6 for engagement with contact 8. The pin contact 7 is in surface engagement with the annular member 6 and hence is always electrically connected to the end of resistor 5.

As previously stated, the movable auxiliary contact 7 is coupled for movement with the movable main contact 3*b* by means of a follower device. To this end, the auxiliary pin contact 7 is joined to a rod 9 through an intermediate rod section 7*a* of insulation material. Rod 9 carried a coupling latch member 10 and a surrounding compression spring 12 which forces the rod 9 toward the left until the rod head 11 makes contact with a carrier member 13 through which rod 9 slides, the carrier member 13 being secured to the movable main contact 3*b*. A latch lever 14 supported on the carrier 13 is biassed by a leaf spring 14*a* in a clockwise direction for engagement at one end with the lower end of latch member 10 when the movable main contact 3*b* is slid to the left from the position depicted in FIG. 1 to the position depicted in FIG. 2*a*. The other end of latch lever 14 is adapted to engage a cammed surface on an abutment 15 secured to the guide part 4 when in the position depicted in FIG. 1 so as to release the lever from the latch member.

The operation of the embodiment illustrated in FIGS. 1 and 2*a*, 2*b* is as follows:

Starting from the off-position shown in FIG. 1, the movable contact 3*b*, and the movable auxiliary contact 7, are moved together to the left. This simultaneously movement of the auxiliary contact 7 is accomplished by the follower device acting through carrier 13 and the spring 12, the carrier moving along with it the latch 10 which is fastened to the rod 9. The auxiliary contacts 7, 8 for the resistor 5 will engage first, thus placing the resistor 5 into the circuit at a time when the main contacts 3*a*, 3*b* have not yet made contact with each other. FIG. 2*a* shows the resistor switched-in position, with the main contacts 3*a*, 3*b* being engaged part of the way in a telescoped manner. The auxiliary contacts 7, 8 are in frontal contact and the spring 12 is compressed. In this position the end of latch lever 14 can and does engage the lower end of the coupling latch 10 thus holding spring 12 in a compressed state.

The main contact 3b is moved to the right when engagement between contacts 3a and 3b is to be broken. The auxiliary contacts 7, 8 will now be the first contacts to open since they follow the parts 10–14. FIG. 2b depicts a transient intermediate position with the contacts 7, 8 already separated, while the contacts 3a, 3b are just beginning to separate from each other. At the conclusion of the circuit-breaking operation the switch components will again be in the position shown by FIG. 1, and the cammed part 15 has served to disengage the latch lever 14 from latch 10.

In the case of the other species illustrated by FIGS. 3a to 3c, parts corresponding to parts shown by FIG. 1 are denoted by identical reference numerals. Here, the movable main switch contact 3b is provided with a lateral extension 3c, on which two levers 16b are pivotally mounted at one end. Two levers 16a are pivotally connected at one end to the other ends of levers 16b and to the rod 9 at their other ends. In conjunction with a spring 17 there is thus formed an over-center knee action joint which can work back and forth across its dead-center position. FIG. 3a depicts the off-position of the switch. During a circuit-closing movement toward the left, the resistor 5 will again be connected first. FIG. 3b depicts the moment when the main contacts 3a, 3b are just beginning to engage while the auxiliary contacts 7, 8 have been engaged for some time. A comparison with FIG. 3a shows that the knee action joint is now close to its stretched-out dead center position. FIG. 3c depicts the time when the circuit-closing is completed and with the knee action joint already worked back across dead-center by continued movement of main contact 3b. Auxiliary contacts 7, 8 have thus been reopened when the main contacts 3a, 3b are fully engaged. The working back of the knee action joint from the position shown in FIG. 3c to the position of FIG. 3a is accomplished by the head 11 on the rod 9 upon its impact with a lateral extension 4c on guide part 4, which also carries one end of the resistor 5, when the movable contact 3b moves back to the switched-out position.

Thus as has now been described, the invention provides for connection of a resistor member 5 into the circuit between the stationary and movable main contacts 3a, 3b of an electrical switch by means of a pair of auxiliary stationary and movable contacts 7, 8 prior to engagement of the main contacts during a switching-in operation, and a disconnection of the resistor not later than dis-engagement of the main contacts during a switching-out operation. The movable one of the auxiliary contacts is coupled to the movable main contact by means of the described follower device which effects closure of the auxiliary contacts prior to engagement of the main contacts. The difference between the embodiment shown in FIGS. 1 and 2a, 2 b and that shown in FIGS. 3a, 3b and 3c is due to the difference in the follower arrangements coupling the movable auxiliary contact 7 and the main movable contact 3b, the former being such that disengagement between the auxiliary contacts does not take place until the main contact 3b starts its disengagement motion whereas in the latter, the auxiliary contacts have disengaged when the main contacts reach their full switched-in position by the pushing action to the right on the composite rod formed by sections 7, 7a and 9 due to its abutment with the stationary auxiliary contact 8.

We claim:

1. In an electrical switch comprising a set of main contacts one of which is stationary and the other movable thereby to effect engagement and dis-engagement therebetween, the improvement which comprises a resistor and a set of auxiliary contacts for connection of said resistor between said set of main contacts prior to engagement therebetween during a switching-in operation and disconnection of said resistor not later than disengagement of said set of main contacts during a switching-out operation, one of said auxiliary contacts being electrically connected to said stationary main contact and the other of which is slidable relative to said movable main contact and insulatively coupled thereto by means of a follower device, one end of said resistor being electrically connected to said movable main contact and the other end electrically connected to said slidable auxiliary contact, said follower device including a carrier member therefor secured to said movable main contact, a rod slidable in said carrier member, a latch member secured to said rod, a compression spring surrounding said rod between said latch member and said carrier member for actuating said rod, said rod including an electrically insulating section to which is joined said slidable auxiliary contact, and a latching lever on said carrier member cooperative with said latch member for engaging the latter when said spring has been compressed upon engagement between said set of a auxiliary contacts prior to engagement of said main contacts, said latching lever being dis-engaged from said latch member upon a return of said movable main contact to its dis-engaged position.

2. An electrical switch as defined in claim 1 wherein said follower device includes a carrier member therefor secured to said movable main contact, a rod slidable in said carrier member, a latch member secured to said rod, a compression spring surrounding said rod between said latch member and said carrier member for actuating said rod, said rod including an electrically insulating section to which is joined said slidable auxiliary contact, and a latching lever on said carrier member cooperative with said latch member for engaging the latter when said spring has been compressed upon engagement between said set of auxiliary contacts prior to engagement of said main contacts, said latching lever being disengaged from said latch member upon a return of said movable main contact to its dis-engaged position.

3. In an electrical switch comprising a set of main contacts one of which is stationary and the other movable thereby to effect engagement and dis-engagement therebetween, the improvement which comprises a resistor and a set of auxiliary contacts for connection of said resistor between said set of main contacts prior to engagement therebetween during a switching-in operation, one of said auxiliary contacts being electrically connected to said stationary main contact and the other of which is slidable relative to said movable main contact and insulatively coupled thereby by means of a follower device, one end of said resistor being electrically connected to said movable main contact and the other end electrically connected to said slidable auxiliary contact, said follower device including a carrier member therefor secured to said movable main contact, a rod slidable in said carrier member, said rod including an electrically insulating section to which is joined said slidable auxiliary contact, a spring-loaded over-center lever system mounted on said carrier member, said lever system including two pairs of pivotally connected levers, one end of each lever pair being pivotally connected to said carrier member and the opposite ends of said lever pairs being pivotally connected to each other and to said slidable rod and a spring interconnecting the pivotal connection points between said lever pairs, said rod being actuated in the reverse direction following engagement of said set of auxiliary contacts and continued movement of said movable main contact during a switching-in operation serving to shift said lever system across its dead-center position and thereby effect a disengagement of said set of auxiliary contacts, the end of said rod engaging a stop during a return movement of said movable main contact in a switching-out operation and being reversed in direction so as to again shift said lever system across its dead-center position to the starting position.

* * * * *